US008047759B2

(12) United States Patent
Ladd

(10) Patent No.: US 8,047,759 B2
(45) Date of Patent: Nov. 1, 2011

(54) MANUAL FORKLIFT APPARATUS AND METHODS

(75) Inventor: Jim L. Ladd, Erie, CO (US)

(73) Assignee: Wazee Group, Inc., Erie, CO (US)

( * ) Notice: Subject to any disclaimer, the term of this patent is extended or adjusted under 35 U.S.C. 154(b) by 72 days.

(21) Appl. No.: 12/399,731

(22) Filed: Mar. 6, 2009

(65) Prior Publication Data

US 2010/0226742 A1 Sep. 9, 2010

(51) Int. Cl.
*B66C 23/00* (2006.01)

(52) U.S. Cl. ..... 414/686; 414/685; 414/715

(58) Field of Classification Search ..... 414/467, 414/490, 495, 509, 685, 686, 687, 690, 692, 414/697, 715, 728, 707, 713
See application file for complete search history.

(56) References Cited

U.S. PATENT DOCUMENTS

| | | | | | |
|---|---|---|---|---|---|
| 3,069,031 | A | * | 12/1962 | O'Leary | 414/476 |
| 3,184,086 | A | | 5/1965 | Lull | |
| RE30,021 | E | * | 6/1979 | Olson et al. | 414/547 |
| 4,306,832 | A | * | 12/1981 | Schmiesing | 414/718 |
| 4,531,720 | A | * | 7/1985 | Soder | 269/71 |
| 4,553,899 | A | * | 11/1985 | Magni | 414/629 |
| 4,964,778 | A | * | 10/1990 | Muto et al. | 414/700 |
| 5,051,057 | A | * | 9/1991 | Kremer | 414/685 |
| 5,199,861 | A | * | 4/1993 | Merlo et al. | 414/718 |
| 5,211,526 | A | * | 5/1993 | Robinette | 414/550 |
| 5,269,501 | A | | 12/1993 | Liegel et al. | |
| 5,338,015 | A | | 8/1994 | Liegel et al. | |
| 5,375,963 | A | | 12/1994 | Wohlwend | |
| 5,709,523 | A | | 1/1998 | Ware | |
| 6,601,825 | B2 | | 8/2003 | Bressner et al. | |
| 6,910,544 | B2 | * | 6/2005 | Sewell | 180/68.4 |
| 7,207,549 | B2 | | 4/2007 | Crawford | |
| 2008/0044265 | A1 | | 2/2008 | Borntrager et al. | |

FOREIGN PATENT DOCUMENTS

GB 2292730 A 6/1996

* cited by examiner

*Primary Examiner* — Saul Rodriguez
*Assistant Examiner* — Glenn Myers
(74) *Attorney, Agent, or Firm* — Kilpatrick Townsend & Stockton, LLP

(57) ABSTRACT

A manual forklift for lifting, maneuvering, and arranging palleted freight, comprising an extensible wheeled base, a steering handle, a mast, and a boom with a descending standard secured to a support frame carriage and forward extending tines. Hydraulic jack cylinders joining the mast to the boom and the boom to the descending standard in concert with hinge joints connecting the mast to the boom and the boom to the descending standard allow the tines to be manipulated forwardly or backwardly, raised or lowered, and tilted upwardly or downwardly relative to the mast and base, enabling the user to transfer palleted freight engaged by the tines between surfaces with differing heights and angles and across longitudinal spaces. Castered wheels affixed to the base further enable freight to be moved multi-directionally, including laterally leftward or rightward.

20 Claims, 8 Drawing Sheets

MANUAL FORKLIFT APPARATUS AND METHODS

BACKGROUND OF THE INVENTION

Embodiments of the present invention relate generally to the field of forklift devices and more particularly to manually operated forklift systems and methods for loading and unloading freight.

Manual forklifts are useful for the efficient movement and organization of materials and goods. They enable an individual to quickly lift and transport a product in quantities and masses that the individual could not physically endure alone. Furthermore, manual forklifts allow for the orderly and controlled placement and storage of products in a manner that maximizes the use of space and time. To date, a variety of apparatuses designed for the lifting, transporting, and placement of objects by manual means have been described. Such systems include hoists for the lifting and moving of heavy objects, loads, and other freight.

Although these and other approaches may provide helpful techniques for lifting and moving heavy items, still further advances would be desirable. For example, it would be desirable to provide systems and methods which could be used to engage multiple loads at a time. It would also be desirable to provide a manually managed means for engaging, lifting, relocating, and positioning multiple products simultaneously in an efficient and cost-effective manner.

Further, it would be desirable to provide methods for forwardly and backwardly moving the engaged objects such as pallets, for example when loading or unloading palleted material to or from a delivery truck. Additionally, it would be desirable to provide systems and methods that could be used in situation which provide limited space for maneuverability. What is more, it would be desirable to provide techniques that accomplish the loading or unloading of palleted material between a delivery truck and a loading dock, where the truck and dock have different heights. Embodiments of the present invention provide solutions that address the problems described above, and hence provide answers to at least some of these outstanding needs.

BRIEF SUMMARY OF THE INVENTION

Advantageously, embodiments of the present invention provide useful and beneficial systems and methods that allow a user to efficiently lift, move, place, and organize multiple palleted goods simultaneously from a variety of heights, angles, directions, and distances as well as between surfaces of varying heights. For example, embodiments encompass an apparatus having a manual forklift having the ability to lift loads from beneath the load, thus allowing multiple products to be stacked as on a pallet and therefore to be engaged, moved, and manipulated at one time.

Embodiments further encompass systems and methods that allow a user to reposition the engaged goods in an upward, downward, forward, backward, forward-tilted, backward-tilted, laterally leftward, or laterally rightward manner. Configurations provided by embodiments disclosed herein allow goods to be maneuvered more efficiently and effectively within the confined area of a delivery truck as well as between a delivery truck and a loading dock of differing heights. Exemplary embodiments provide a single manual forklift that can reach, for example, both up and into a delivery truck from a loading dock and remove palleted freight intact. In some cases, such embodiments may obviate the need for a second forklift on the truck to offload the material to the dock. What is more, such embodiments can eliminate or reduce the time and cost-consuming and physically demanding processes of unloading and repositioning individual parcels from within a palleted load onto a dock from a delivery truck. Still further, embodiments provide manually powered systems and methods, which can reduce the size, weight, cost, and negative environmental impact associated with motorized and electronically powered forklifts.

Forklift system and method embodiments provided herein are well suited for use in transporting objects between locations having differing heights, for example a forklift on the loading dock can reach both up and into the cargo bay of a delivery truck in order to engage the palleted freight. Exemplary manual forklifts can also enable an individual to simultaneously engage multiple palleted products from a variety of angles, heights, and distances, transport them across a surface, and deposit them in a new position. Forklift embodiments also allow the lateral movement as well as the upward and downward tilting and the forward and backward manipulation of lifted palleted material, for example as within a delivery truck or between a delivery truck and loading dock of differing heights. Exemplary forklift embodiments may avoid, through the employment of a manually-powered system, the increased size, weight, and cost of a motorized or electronically powered forklift as well as the negative environmental impact associated with motorized and electronically powered apparatuses.

In one aspect, embodiments of the present invention encompass manual fork lift systems for lifting and transporting a cargo. Exemplary systems include a frame having a base, a mast pivotally coupled with the base, an extendable boom pivotally coupled with the mast, and an engagement mechanism pivotally coupled with the extendable boom. The extendable boom can include a proximal support element and a distal support element that is slidably engaged with the proximal support element. A system may also include a first single-action hydraulic jack having a base and a ram, where the base of the first single-action hydraulic jack is pivotally coupled with the base of the frame, and the ram of the first single-action hydraulic jack is pivotally coupled with the extendable boom of the frame. A system may also have a second single-action hydraulic jack having a base and a ram, where the base of the second single-action hydraulic jack is pivotally coupled with a lower portion of the engagement mechanism of the frame via a first adjustable coupling mechanism, and the ram of the second single-action hydraulic jack is pivotally coupled with the extendable boom of the frame via a second adjustable coupling mechanism. In some cases, the first adjustable coupling mechanism allows the base of the second single-action hydraulic jack to be adjustably positioned relative to a bottom end of the engagement mechanism. Similarly, the second adjustable coupling mechanism can allow the ram of the second single-action hydraulic jack to be adjustably positioned along a length of the extendable boom.

In some embodiments, the first adjustable coupling mechanism includes a jack support having a first aperture, an engagement mechanism bracket having a second aperture, and a pin that can be received through the first aperture and the second aperture. The jack support can be coupled with the base of the second single-action hydraulic jack. In some embodiments, the base of the second single-action hydraulic jack can include a first aperture, and the first adjustable coupling mechanism can include an engagement mechanism bracket having a second aperture, and a pin that can be received through the first aperture and the second aperture. Optionally, the boom may include an aperture, and the second adjustable coupling mechanism can include a boom bracket having an aperture, and a pin that can be received through the boom bracket aperture and the boom aperture. The ram of the second single-action hydraulic jack can be coupled with the boom bracket. The boom may include a plurality of apertures, and the second adjustable coupling mechanism may include a boom bracket having a plurality of apertures, and a pin. The ram of the second single-action hydraulic jack can be coupled with the boom bracket. In some cases, the boom proximal support element includes an aperture, and the boom distal support element includes an aperture. The second adjustable coupling mechanism may include a boom bracket having an aperture, and a pin that can be received through the boom proximal support element aperture, the boom distal support element aperture, and the bracket aperture. The ram of the second single-action hydraulic jack can be coupled with the boom bracket. In some cases, the boom proximal support element includes a plurality of apertures, and the boom distal support element comprises a plurality of apertures. The second adjustable coupling mechanism may include a boom bracket having a plurality of apertures, and a pin. The ram of the second single-action hydraulic jack can be coupled with the boom bracket.

In another aspect, embodiments of the present invention encompass manual fork lift systems for lifting and transporting a cargo. Exemplary manual fork lift systems may include a frame having a base, a mast pivotally coupled with the base, an extendable boom pivotally coupled with the mast, and an engagement mechanism pivotally coupled with the extendable boom. The extendable boom can include a proximal support element and a distal support element that is slidably engaged with the proximal support element. The system can also include a first single-action hydraulic jack having a base and a ram, where the base of the first single-action hydraulic jack is pivotally coupled with the base of the frame, and the ram of the first single-action hydraulic jack is pivotally coupled with the extendable boom of the frame. The system may also include a second single-action hydraulic jack having a base and a ram, where the base of the second single-action hydraulic jack is pivotally coupled with a lower portion of the engagement mechanism of the frame via a first adjustable coupling mechanism, and the ram of the second single-action hydraulic jack is pivotally coupled with the extendable boom of the frame via a second adjustable coupling mechanism. The first adjustable coupling mechanism can allow the base of the second single-action hydraulic jack to be adjustably positioned relative to a bottom end of the engagement mechanism. The second adjustable coupling mechanism can allow the ram of the second single-action hydraulic jack to be adjustably positioned along a length of the extendable boom. The boom proximal support element can include an aperture, and the boom distal support element can include an aperture. The second adjustable coupling mechanism can include a boom bracket having an aperture, and a pin that can be received through the boom proximal support element aperture, the boom distal support element aperture, and the bracket aperture. The ram of the second single-action hydraulic jack can be coupled with the boom bracket The second single-action hydraulic jack can be coupled with the frame of the manual fork lift system such that a release valve of the base of the second single-action hydraulic jack remains below the ram of the second single-action hydraulic jack during operation of the manual fork lift system. In some cases, the first adjustable coupling mechanism includes a jack support having a first aperture, an engagement mechanism bracket having a second aperture, and a pin that can be received through the first aperture and the second aperture. The jack support can be coupled with the base of the second single-action hydraulic jack. In some cases, the base of the second single-action hydraulic jack can include a first aperture, and the first adjustable coupling mechanism can include an engagement mechanism bracket having a second aperture, and a pin that can be received through the first aperture and the second aperture. Optionally, the boom may include a plurality of apertures, and the second adjustable coupling mechanism can include a boom bracket having a plurality of apertures, and a pin. The ram of the second single-action hydraulic jack can be coupled with the boom bracket.

According to some embodiments, the boom proximal support element can include a plurality of apertures, and the boom distal support element can include a plurality of apertures. The second adjustable coupling mechanism can include a boom bracket having a plurality of apertures, and a pin. The ram of the second single-action hydraulic jack can be coupled with the boom bracket. In some cases, the engagement mechanism can pivot relative to the extendable boom throughout an angular range of motion, and the angular range of motion or the limits of the angular range of motion can be changed by adjusting the first adjustable coupling mechanism, by adjusting the second adjustable coupling mechanism, or by adjusting both the first adjustable coupling mechanism and the second adjustable coupling mechanism.

In still a further aspect, embodiments of the present invention encompass methods of constructing a manual fork lift system. Exemplary methods may include providing a frame having a base, a mast pivotally coupled with the base, an extendable boom pivotally coupled with the mast, and an engagement mechanism pivotally coupled with the extendable boom. The extendable boom can include a proximal support element and a distal support element that is slidably engaged with the proximal support element. Methods may also include providing a first single-action hydraulic jack having a base and a ram, and the base of the first single-action hydraulic jack can be pivotally coupled with the base of the frame. The ram of the first single-action hydraulic jack can be pivotally coupled with the extendable boom of the frame. Methods may also include providing a second single-action hydraulic jack having a base and a ram. The base of the second single-action hydraulic jack can be pivotally coupled with a lower portion of the engagement mechanism of the frame via a first adjustable coupling mechanism. The ram of the second single-action hydraulic jack can be pivotally coupled with the extendable boom of the frame via a second adjustable coupling mechanism. Methods may also include constructing the manual fork lift system such that the first adjustable coupling mechanism allows the base of the second single-action hydraulic jack to be adjustably positioned relative to a bottom end of the engagement mechanism, and such that the second adjustable coupling mechanism allows the ram of the second single-action hydraulic jack to be adjustably positioned along a length of the extendable boom. In some cases, the first adjustable coupling mechanism includes a jack support having a first aperture, an engagement mechanism bracket having a second aperture, and a pin that can be received through the first aperture and the second aperture. The jack support can be coupled with the base of the second single-action hydraulic jack. In some cases, the base of the second single-action hydraulic jack can include a first aperture, and the first adjustable coupling mechanism can include an engagement mechanism bracket having a second aperture, and a pin that can be received through the first aperture and the second aperture. In some cases, the boom includes an aperture, and the second adjustable coupling mechanism includes a boom bracket having an aperture, and a pin that can be received through the boom bracket aperture and the boom aperture. The ram of the second single-action hydraulic jack can be coupled with the boom bracket. In some cases, the boom includes a plurality of apertures, and the second adjustable coupling mechanism includes a boom bracket having a plurality of apertures, and a pin. The ram of the second single-action hydraulic jack can be coupled with the boom bracket. In some cases, the boom proximal support element can include an aperture, and the boom distal support element can include an aperture. The second adjustable coupling mechanism can include a boom bracket having an aperture, and a pin that can be received through the boom proximal support element aperture, the boom distal support element aperture, and the bracket aperture. The ram of the second single-action hydraulic jack can be coupled with the boom bracket. In some cases, the boom proximal support element includes a plurality of apertures, and the boom distal support element includes a plurality of apertures. The second adjustable coupling mechanism can include a boom bracket having a plurality of apertures, and a pin. The ram of the second single-action hydraulic jack can be coupled with the boom bracket In another aspect, embodiments of the present invention encompass manual fork lifts that include a supporting extensible base mounted on wheels, a vertically disposed support affixed to the base, an extensible horizontally disposed arm rotatable and attached to the vertically disposed support, wherein the horizontally disposed arm is connected to the vertically disposed support and rotated by a first hydraulic device, and a lifting element having tines for engaging and lifting an object, wherein the lifting element is rotatable and connected to the extensible horizontally disposed arm, and wherein the lifting element is configured to be moved by a second hydraulic device, whereby second hydraulic device rotates the lifting element and extends the extensible horizontal arm.

In still another aspect, embodiments of the present invention include a fork lift for lifting and transporting objects. The fork lift includes an extensible base having a vertically disposed support configured to receive a horizontally disposed rotatable arm having a first lifting device configured so that an object may be lifted by the lifting device and rotated by the rotatable arm.

In yet another aspect, embodiments of the present invention include an apparatus for moving objects. The apparatus includes an extensible support base, wherein the support base is adapted to be moved. The apparatus also includes a vertical member attached to the support base. The vertical member includes a rotatable extensible horizontal member that is adapted to receive a lifting fork. The lifting fork can be raised and lowered by a lifting means. In some cases, an object can be raised or lowered by the lifting fork, rotated by the horizontal member, and moved by the extensible base.

In another aspect, embodiments of the present invention encompass methods of transporting an object. Exemplary methods may include providing or maneuvering a forklift apparatus as described herein, engaging the object with the forklift apparatus, lifting the object with the forklift apparatus, and moving the object with the forklift apparatus. In some cases, methods may include rotating the object with the forklift apparatus.

Other benefits and advantages of the invention will appear from the disclosure to follow. In the disclosure reference is made to the accompanying drawings, which form a part hereof and in which is shown by way of illustration specific embodiments in which the invention may be practiced. Embodiments will be described in sufficient detail to enable those skilled in the art to practice the invention, and it is to be understood that other embodiments may be utilized and that structural changes may be made in details of the embodiments without departing from the scope of the invention.

DETAILED DESCRIPTION OF THE INVENTION

Embodiments of the present invention include manual forklift systems and methods for lifting, transporting, and arranging palleted freight. An exemplary apparatus may include a vertical, back-tilted mast rising from a wheeled, A-frame base whose castered wheels allow for multi-directional transport along a surface, and may be propelled and directed via a steering handle attached to the back of the mast just above dual support columns that extend upwardly at a slight angle from the rear crossbeam of the A-frame base to the mast. In some cases, a vertical hydraulic jack cylinder can be attached near the base of the back-tilted mast, extending upward to an adjustable-length boom that protrudes forwardly from the pinnacle of the mast to which it is attached. The boom may be attached via a hinge joint and may be raised and lowered via a conventional hydraulic crank thus raising and lowering the palleted freight. The freight may be engaged via a pair of L-shaped fork-like tines whose tops extending forwardly from and perpendicular to a rectangular support frame carriage attached to a vertical standard that is secured to and descends from the front end of the boom.

A descending vertical standard may also be attached to the boom via a second hydraulic jack cylinder that extends in a downward and forward angle from the back half of the boom to the lower end of the descending vertical standard. The second hydraulic jack can be extended or rescinded as well as raised or lowered via a hand-powered handle to tilt the palleted freight, thus engaging tines and concomitant freight upwardly or downwardly as well as forwardly or backwardly relative to the mast and base of the apparatus. The L-shaped tines can be affixed along a cylindrical rod of the support frame carriage running through circular openings in the tops of the tines. The bases of the L-shaped tines can be supported by a bottom cross-member of the support frame carriage. The tines may be repositioned along the length of the cylindrical rod. The castered wheels of the base may further allow the engaged freight to be slid laterally to the left or right within confined areas. The base, mast, base-to-mast support columns, steering handle, descending vertical standard, rectangular support carriage, and tines of the apparatus can include solid metal casings, and the boom can include an elongated hollow metal housing with a second hollow, elongated metal element mounted and secured within the opposing end of the first housing. The forward end of this second elongated element can be attached to the descending standard via a flexible hinge joint allowing for the upward and downward tilting as well as the forward extension and backward retrieval of the tines affixed to the rectangular support carriage and the engaged, palleted freight through the action of the angularly attached, second hydraulic cylinder.

Figure 1:
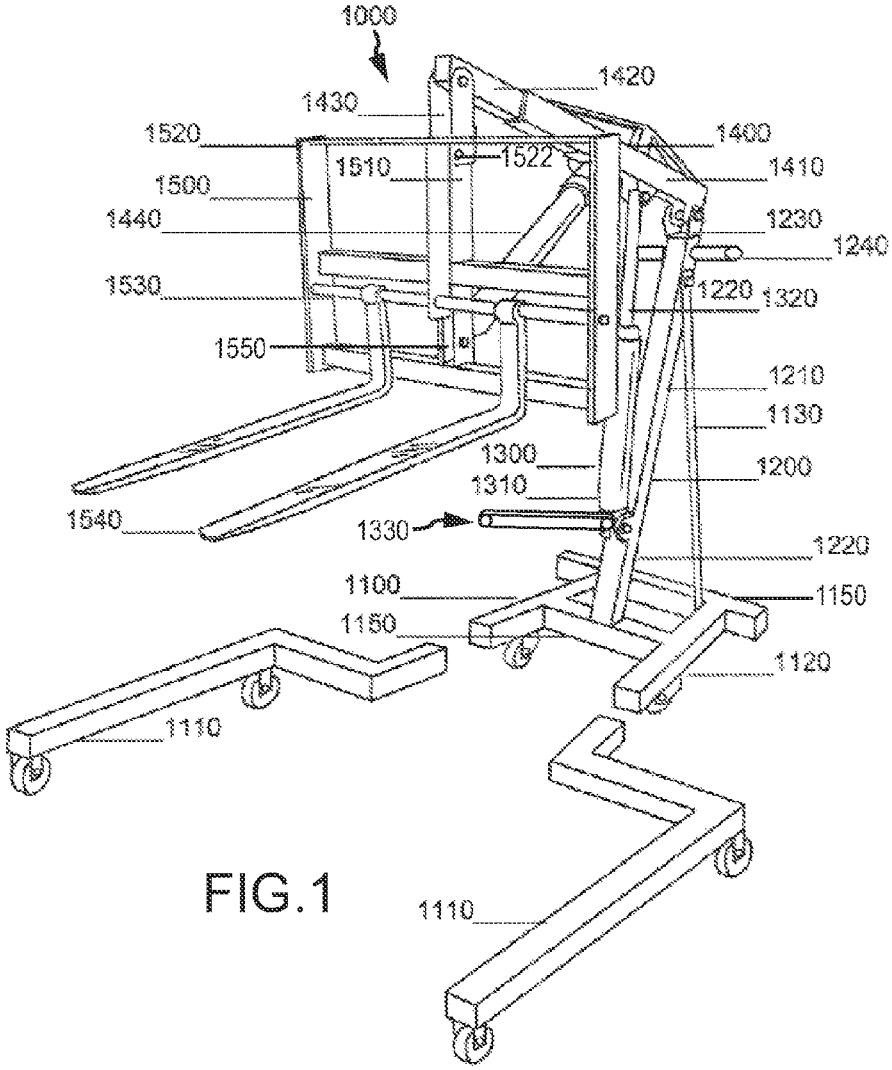
FIG. 1 illustrates aspects of a forklift system according to embodiments of the present invention.

With reference to FIG. 1, an embodiment of an apparatus 1000 for manually lifting, transporting, and repositioning palleted freight (not pictured) is illustrated. The apparatus 1000 includes a manual forklift or pallet jack that includes a base 1100 in an A-frame configuration with two forwardly and outwardly extending castered legs. The castered legs are extendable by means of caster wheeled extensions 1110, that allow the apparatus to be maneuvered across a floor or supporting surface. The movement of the apparatus 1000 enabled by the castered wheels 1120 and can be directed manually via a steering handle 1240. The steering handle can be mounted perpendicularly to the back of the boom housing element 1410 or toward the top of the vertical mount 1200. In some cases, boom housing element 1410 can be connected to a vertical mast or mount 1200 which is supported by vertical mast supports 1130 that rise or extend upward from the rear of the two base crossbeams 1150. As shown here, vertical mast or mount 1200 is coupled with vertical mast supports 1130 and can rise or extend from the more forward of the two base crossbeams 1150. Such configurations can allow palleted freight which is engaged and lifted by the apparatus 1000 to be maneuvered multi-directionally and within areas of confined space by a user or operator.

The mast 1200, which can include an upper portion 1210 and a lower portion 1220, provides for stability while the apparatus 1000 engages a load. The mast 1200 is secured at its apex to a boom 1400 via a flexible hinge joint 1230 that, through the action of a vertical hydraulic jack 1300 bolted to or coupled with the mast 1200 near the mast's base and to the boom 1400 near the boom's back third, allows palleted freight engaged by the apparatus 1000 to be raised and lowered in relation to the mast 1200 and base 1100. The vertical hydraulic jack 1300 includes a jack base 1310 and a sliding cylinder 1320 operated in a conventional manner utilizing a conventional hydraulic jack crank handle 1330.

Figure 2:
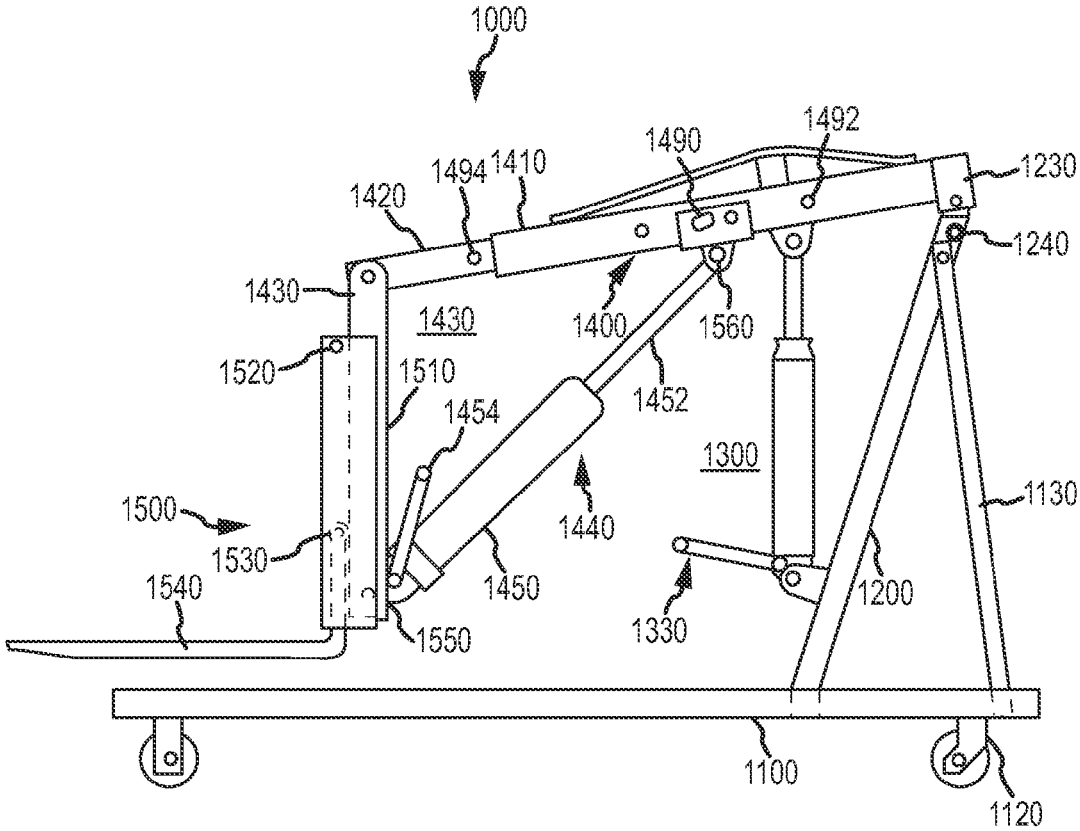
FIG. 2 illustrates aspects of a forklift system according to embodiments of the present invention.

The boom 1400 extends forwardly from the mast 1200 and includes an elongated, hollowed, exterior, extension housing element 1410, bolted at its posterior to the mast 1200 via the mast hinge joint 1230, and an interior, hollowed extension element 1420 that extends forwardly from the anterior opening of the exterior extension element 1410. The interior extension element 1420 is sized to fit in a slidable manner and adjustably within the opposed end of the exterior extension element 1410 to which it is secured via conventional hitch pins 1490 (as shown in FIG. 2) inserted into aligned openings or apertures 1492, 1494 drilled in the casing of the exterior 1410 and interior 1420 extension elements, respectively. The slidable adjustable nature of the adjoinment between the exterior 1410 and interior 1420 extension elements allows for palleted loads of differing masses to be securely lifted, moved, and manipulated. Bolted to the forward end of the interior extension element 1420 and forming a flexible hinge joint 1430 is the descending standard 1510, connecting the boom 1400 to a rectangular support frame carriage or engagement mechanism 1500. A top transverse element or cylindrical rod 1520, forming the lid of the rectangular support frame carriage 1500, may be attached with a hinge joint element 1522 and help connect the rest of the frame carriage 1500 with the descending standard 1510. Actuation or extension of the boom hinge 1430 can be effected by the action of a second conventional hydraulic jack 1440 that includes a hydraulic jack base 1450 (as shown in FIG. 2) and a sliding hydraulic jack cylinder or ram 1452 (as shown in FIG. 2).

Operation of the second jack 1440 can be carried out via manipulation of a conventional jack handle 1454 (as shown in FIG. 2). Jack base 1450 is coupled with descending standard 1510 via a hinge 1550 (as shown in FIG. 2). Second jack cylinder is coupled with boom 1400 via a hinge 1560 (as shown in FIG. 2). Hence, second jack 1440 can be affixed flexibly via bolts to a connector plate, forming a hinge joint between the underside of the midsection of the exterior extension element 1410 of the boom 1400 and the boom hydraulic jack 1440, which descends angularly and forwardly from the boom to the lower end of the descending standard 1510 of the support frame carriage 1500, and enables both the forward and backward movement as well as the upward and downward tilting in relation to the mast 1200 and base 1100 of freight engaged and lifted by the apparatus 1000. Engagement of the freight can be with L-shaped tines 1540 that extend forwardly from the base of the support carriage frame 1500 and that slide into the engagement openings of a freight pallet (not pictured) loaded with freight. The bases of the L-shaped tines 1540 are supported by the base of the rectangular support carriage frame 1500 as well as affixed to a cylindrical connector rod 1530 that runs through the midsection of the support frame carriage 1500 parallel to the carriage's base and lid as well as through eye-hole openings in the connecting ends of the L-shaped tine 1540 bases. The L-shaped tines 1540 may be repositioned along the length of cylindrical connector rod 1530.

Figure 3:
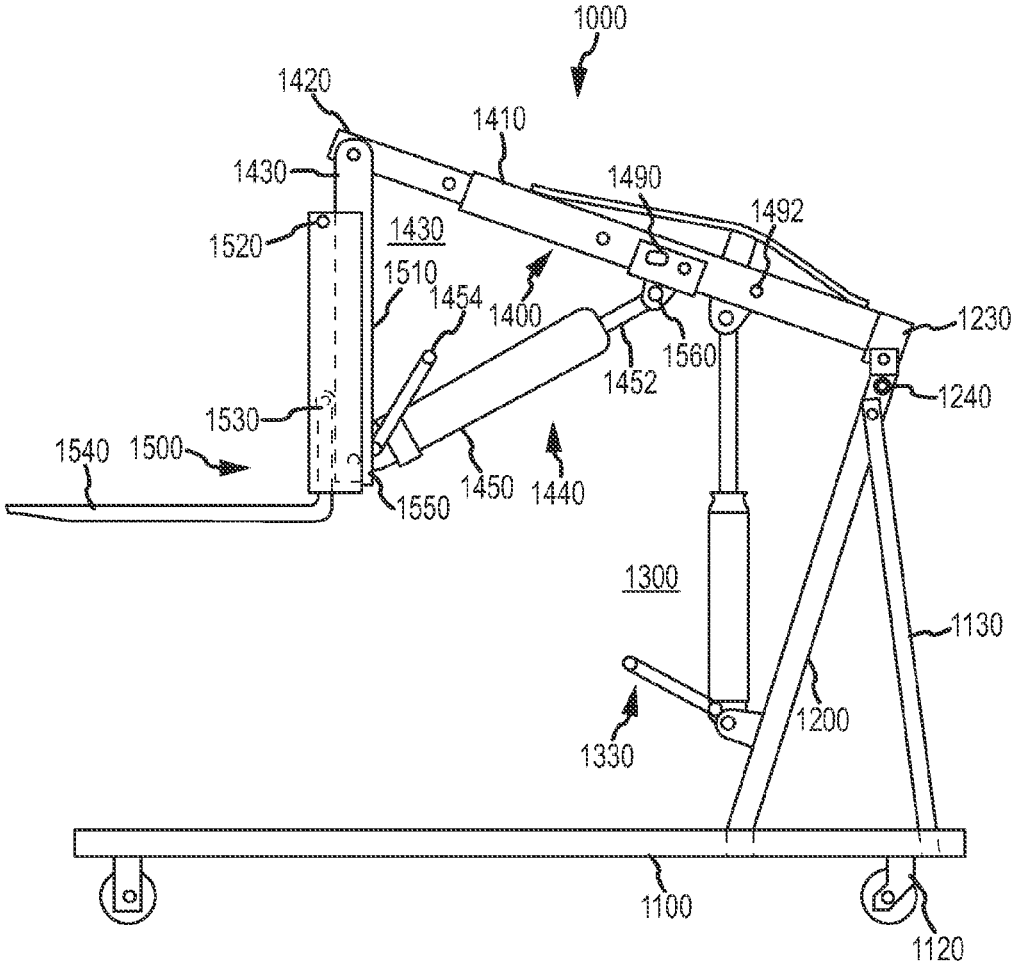
FIG. 3 illustrates aspects of a forklift system according to embodiments of the present invention.

FIG. 2 shows the fork lift lowered and ready to receive a load or lift an object (not shown). As depicted here, the sliding cylinder of the second jack 1440 is coupled with boom 1400 via an adjustable bracket 1460. FIG. 3 shows the fork lift raised to lift and transfer a load or object (not shown.) In operation, the apparatus 1000 can, from a loading dock (not pictured), raise its engagement tines 1540 through the action of the vertical hydraulic jack 1300. As shown here, first jack 1300 is coupled with the mast 1200 and boom 1400. First jack 1300 can be adjusted so that tines 1450 can match the height of palleted freight in the cargo bay of a delivery truck (not pictured) standing at a height that diverges from that of the dock. Through the action of the boom hydraulic jack 1440, the apparatus can then reach into the delivery truck, engage the palleted freight, remove the freight from the truck, transport the freight to a desired location, and disengage the freight, leaving it in that desired location even if that location is at a height or angle or given longitudinal distance different from that of the base of the apparatus 1000.

Figure 4:
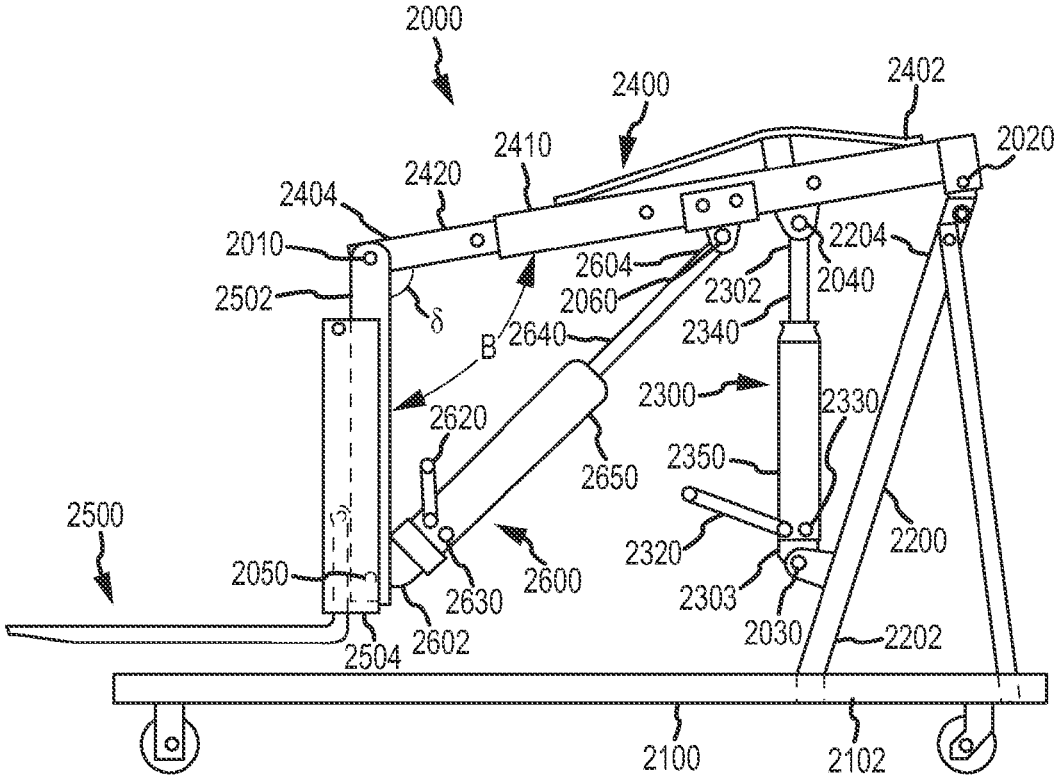
FIGS. 4 and 4A illustrate aspects of a forklift system according to embodiments of the present invention.

FIG. 4 shows a lift system according to embodiments of the present invention. Lift system 2000 includes frame elements such as a base 2100, a mast 2200, a boom 2400, and a lift or engagement mechanism 2500. Lift system 2000 may also include actuating elements such as a first jack 2300 and a second jack 2600. As depicted here, a lower section 2202 of mast 2200 is coupled with a rear section 2102 of base 2100, and an upper section 2204 of mast 2200 is coupled with a rear section 2402 of boom 2400. Relatedly, an upper section 2502 of engagement mechanism 2500 is coupled with a forward section 2404 of boom 2400, such as a portion of a distal support element 2420 of boom 2400. Support element 2420 can be slidably engaged with support element 2410. A lower portion 2303 of first jack 2300 is coupled with mast 2200 or optionally with base 2100. An upper portion 2302 of first jack 2300 is coupled with boom 2400. A lower portion 2602 of second jack 2600 is coupled with engagement mechanism 2500, for example at or toward a lower portion 2504 of the engagement mechanism. An upper portion 2604 of second jack 2600 is coupled with boom 2400, for example with a boom housing element or proximal support element 2410 of the boom 2400.

Figure 4A:
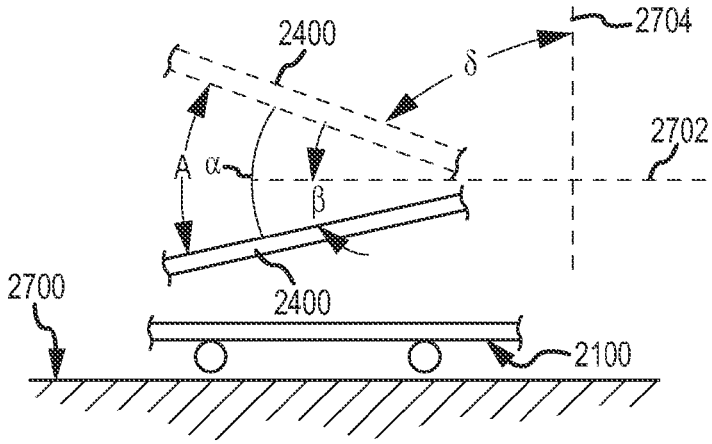

FIG. 4A demonstrates that boom 2400 is configured to move relative to base 2100, or relative to the ground or a resting surface 2700 or a horizontal plane 2702, throughout a range of motion defined by angle α, as depicted by arrow A. Angle β can represent the angle between boom 2400 and a horizontal plane. Angle γ can represent the angle between boom and a vertical plane 2704. The angular orientation of boom 2400 can be changed by actuation of first jack 2300, as jack 2300 is extended and retracted. Relatedly, with returning reference to FIG. 4, angle δ can represent the angle between engagement mechanism 2500 and boom 2400. The angular orientation of engagement mechanism 2500 can be changed by actuation of second jack 2600, as jack 2600 is extended and retracted, thus changing angle δ as shown by arrow B.

According to some embodiments, frame elements can be coupled with other frame elements via hinged or pivoting connections. Similarly, actuating elements can be coupled with frame elements via hinged or pivoting connections. Hence, boom 2400 can be coupled with engagement mechanism 2500 via a hinge 2010. Boom 2400 can be coupled with mast 2200 via a hinge 2020, or optionally with base 2100 via a hinge. First jack 1300 can be coupled with mast 2200 via a hinge 2030, or optionally with base 2100 via a hinge. First jack 1300 can be coupled with boom 2400 via a hinge 2040. Second jack 2600 can be coupled with engagement mechanism 2500 via a hinge 2050, and second jack 2600 can be coupled with boom 2400 via a hinge 2060.

In general, a hydraulic jack can include a base and a ram. In operation, the jack generates movement in response to fluid volume accumulation in the base. A single-acting hydraulic jack typically generates force in one direction, by extending a ram. The ram is returned to the original position by the effect or gravity, a spring, or the like. A hydraulic jack can use an incompressible fluid, such as oil, that is forced into the base as the user operates the handle. As pressure is generated, due to fluid that is directed into the base, the fluid displaces the ram and thereby forces the ram out of the base. In a single-acting or single-action jack, pressurized fluid is accepted on one side of a piston, so as to extend the ram. A pressure-release valve can be actuated to allow the ram to return toward the original or unextended position. In some cases, a pressure-release valve may include a needle-type release valve. Typically, after the fluid pressure is released, gravitational forces, or perhaps a spring mechanism, brings the ram back into the base. As shown in FIG. 4, first jack 2300 includes an actuating handle 2320, a ram 2340, a base 2350, and a pressure release valve 2330. Similarly, second jack 2600 includes an actuating handle 2620, a ram 2640, a base 2650, and a pressure release valve 2630. In some embodiments, during operation, the pressure release valve is maintained in a position disposed below the ram.

In some embodiments, a lift system may include a hydraulic jack such as a 19¼ inch stroke Central Hydraulics 8 ton Super Heavy Duty Long Ram Hydraulic Round Bottom Jack (Harbor Freight Tools, Camarillo Calif.). Optionally, a lift system may include a hydraulic jack such as a 19.4 inch stroke, 24.8-44.1 inch range, 8 ton capacity Torin Big Red jack (Torin Jack, Inc., Ontario Calif.). Similar hydraulic jacks are also suitable for use with lift system embodiments of the present invention. In some embodiments, dual-action hydraulic jacks may be used.

Figure 5A:
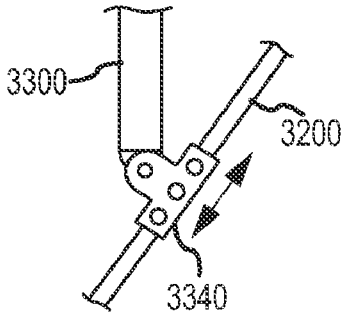
FIGS. 5A-5H illustrate aspects of a forklift system according to embodiments of the present invention.
Figure 5B:
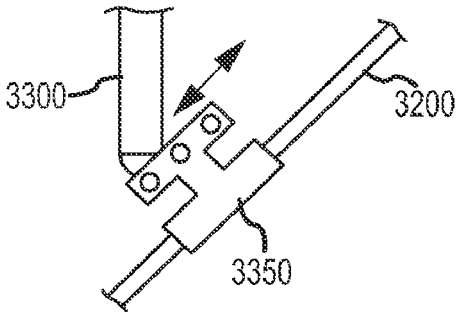
Figure 5C:
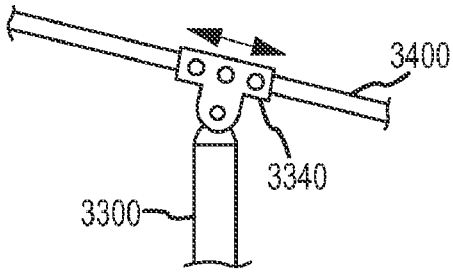
Figure 5D:
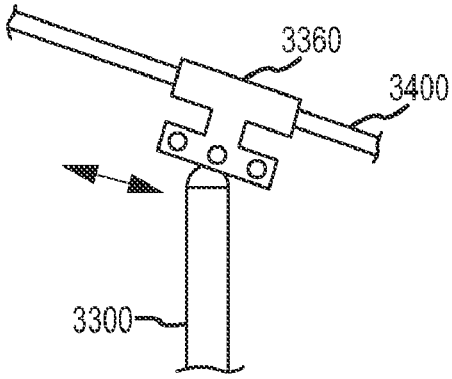
Figure 5E:
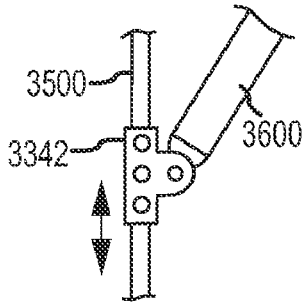
Figure 5F:
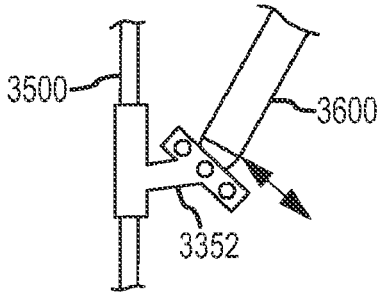
Figure 5G:
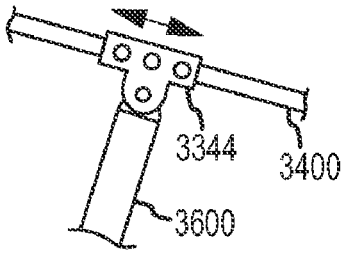
Figure 5H:
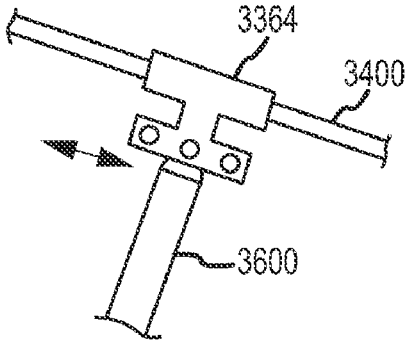

As shown in FIGS. 5A to 5H, actuating elements such as the hydraulic jacks can be coupled with the frame elements in an adjustable configuration. Often, coupling between the hydraulic jacks and the frame elements can be made with bracket or connector configurations that involve pins and apertures, such as those described herein with reference to FIGS. 1 to 3. FIG. 5A shows a coupling between first jack 3300 and mast 3200. As depicted here, the base of first jack 3300 is coupled with a connector 3340 that can be adjustably positioned and secured along the length of mast 3200. Optionally, the base of first jack 3300 can be adjustably positioned and secured along a bracket 3350 which is coupled with mast 3200 or the system base as shown in FIG. 5B. Any of a variety of coupling mechanisms can be employed to adjustably position and secure the base of first jack 3300 relative to the mast 3200 or system base. FIG. 5C shows a coupling between first jack 3300 and boom 3400. As depicted here, the ram of first jack 3300 is coupled with a connector 3340 that can be adjustably positioned and secured along the length of boom 3400. Optionally, the ram of first jack 3300 can be adjustably positioned and secured along a bracket 3360 which is coupled with boom 3400 as shown in FIG. 5D. Any of a variety of coupling mechanisms can be employed to adjustably position and secure the ram of first jack 3300 relative to the boom 3400. FIG. 5E shows a coupling between second jack 3600 and engagement mechanism 3500. As depicted here, the base of second jack 3600 is coupled with a connector 3342 that can be adjustably positioned and secured at a desired position along engagement mechanism 3500. Optionally, the base of second jack 3600 can be adjustably positioned and secured along a bracket 3352 which is coupled with engagement mechanism 3500 as shown in FIG. 5F. Any of a variety of coupling mechanisms can be employed to adjustably position and secure the base of second jack 3600 relative to the engagement mechanism 3500. FIG. 5G shows a coupling between second jack 3600 and boom 3400. As depicted here, the ram of second jack 3600 is coupled with a connector 3344 that can be adjustably positioned and secured along the length of boom 3400. Optionally, the ram of second jack 3600 can be adjustably positioned and secured along a bracket 3364 which is coupled with boom 3400 as shown in FIG. 5H. Any of a variety of coupling mechanisms can be employed to adjustably position and secure the ram of second jack 3600 relative to the boom 3400.

While the above provides a full and complete disclosure of certain embodiments of the present invention, various modifications, alternate constructions and equivalents may be employed as desired. Therefore, the above description and illustrations should not be construed as limiting the invention, which is defined by the appended claims.

What is claimed is:

1. A manual fork lift system for lifting and transporting a cargo, the manual fork lift system comprising:

a frame comprising a base, a mast coupled with the base, an extendable boom pivotally coupled with the mast, and an engagement mechanism pivotally coupled with the extendable boom, wherein the extendable boom includes a proximal support element and a distal support element that is slidably engaged with the proximal support element;

a first single-action hydraulic jack comprising a base and a ram, wherein the base of the first single-action hydraulic jack is pivotally coupled with the base of the frame, and the ram of the first single-action hydraulic jack is pivotally coupled with the extendable boom of the frame; and a second single-action hydraulic jack comprising a base and a ram, wherein the base of the second single-action hydraulic jack is pivotally coupled with a lower portion of the engagement mechanism of the frame via a first adjustable coupling mechanism, and the ram of the second single-action hydraulic jack is pivotally coupled with the extendable boom of the frame via a second adjustable coupling mechanism, wherein the first adjustable coupling mechanism allows the base of the second single-action hydraulic jack to be translationally adjusted alone a length of the engagement mechanism, wherein the second adjustable coupling mechanism allows the ram of the second single-action hydraulic jack to be adjustably positioned along a length of the extendable boom; and wherein the boom comprises a forward section, the engagement mechanism comprises an upper section, and the boom forward section and the engagement mechanism upper section are coupled via a hinge.

2. The manual fork lift system according to claim 1, wherein the first adjustable coupling mechanism comprises a jack support having a first aperture, an engagement mechanism bracket having a second aperture, and a pin that can be received through the first aperture and the second aperture, wherein the jack support is coupled with the base of the second single-action hydraulic jack.

3. The manual fork lift system according to claim 1, wherein the base of the second single-action hydraulic jack comprises a first aperture, and wherein the first adjustable coupling mechanism comprises an engagement mechanism bracket having a second aperture, and a pin that can be received through the first aperture and the second aperture.

4. The manual fork lift system according to claim 1, wherein the second adjustable coupling mechanism allows the ram of the second single-action hydraulic jack to be translationally adjusted along a length of the extendable boom.

5. The manual fork lift system according to claim 1, wherein the boom comprises a plurality of apertures, wherein the second adjustable coupling mechanism comprises a boom bracket having a plurality of apertures, and a pin, and wherein the ram of the second single-action hydraulic jack is coupled with the boom bracket.

6. The manual fork lift system according to claim 1, wherein the boom proximal support element comprise an aperture, wherein the boom distal support element comprises an aperture, wherein the second adjustable coupling mechanism comprises a boom bracket having an aperture, and a pin that can be received through the boom proximal support element aperture, the boom distal support element aperture, and the bracket aperture, and wherein the ram of the second single-action hydraulic jack is coupled with the boom bracket.

7. The manual fork lift system according to claim 1, wherein the boom proximal support element comprises a plurality of apertures, wherein the boom distal support element comprises a plurality of apertures, wherein the second adjustable coupling mechanism comprises a boom bracket having a plurality of apertures, and a pin, and wherein the ram of the second single-action hydraulic jack is coupled with the boom bracket.

8. A manual fork lift system for lifting and transporting a cargo, the manual fork lift system comprising:

a frame comprising a base, a mast coupled with the base, an extendable boom pivotally coupled with the mast, and an engagement mechanism pivotally coupled with the extendable boom, wherein the extendable boom includes a proximal support element and a distal support element that is slidably engaged with the proximal support element;

a first single-action hydraulic jack comprising a base and a ram, wherein the base of the first single-action hydraulic jack is pivotally coupled with the base of the frame, and the ram of the first single-action hydraulic jack is pivotally coupled with the extendable boom of the frame; and a second single-action hydraulic jack comprising a base and a ram, wherein the base of the second single-action hydraulic jack is pivotally coupled with a lower portion of the engagement mechanism of the frame via a first adjustable coupling mechanism, and the ram of the second single-action hydraulic jack is pivotally coupled with the extendable boom of the frame via a second adjustable coupling mechanism, wherein the first adjustable coupling mechanism allows the base of the second single-action hydraulic jack to be adjustably positioned relative to a bottom end of the engagement mechanism, wherein the second adjustable coupling mechanism allows the ram of the second single-action hydraulic jack to be adjustably positioned along a length of the extendable boom, wherein the boom proximal support element comprise an aperture, wherein the boom distal support element comprises an aperture, wherein the second adjustable coupling mechanism comprises a boom bracket having an aperture, and a pin that can be received through the boom proximal support element aperture, the boom distal support element aperture, and the bracket aperture, and wherein the ram of the second single-action hydraulic jack is coupled with the boom bracket, and wherein the second single-action hydraulic jack is coupled with the frame of the manual fork lift system such that a release valve of the base of the second single-action hydraulic jack remains below the ram of the second single-action hydraulic jack during operation of the manual fork lift system.

9. The manual fork lift system according to claim 8, wherein the first adjustable coupling mechanism comprises a jack support having a first aperture, an engagement mechanism bracket having a second aperture, and a pin that can be received through the first aperture and the second aperture, wherein the jack support is coupled with the base of the second single-action hydraulic jack.

10. The manual fork lift system according to claim 8, wherein the base of the second single-action hydraulic jack comprises a first aperture, and wherein the first adjustable coupling mechanism comprises an engagement mechanism bracket having a second aperture, and a pin that can be received through the first aperture and the second aperture.

11. The manual fork lift system according to claim 8, wherein the boom comprises a plurality of apertures, wherein the second adjustable coupling mechanism comprises a boom bracket having a plurality of apertures, and a pin, and wherein the ram of the second single-action hydraulic jack is coupled with the boom bracket.

12. The manual fork lift system according to claim 8, wherein the boom proximal support element comprises a plurality of apertures, wherein the boom distal support element comprises a plurality of apertures, wherein the second adjustable coupling mechanism comprises a boom bracket having a plurality of apertures, and a pin, and wherein the ram of the second single-action hydraulic jack is coupled with the boom bracket.

13. The manual fork lift system according to claim 8, wherein the engagement mechanism can pivot relative to the extendable boom throughout an angular range of motion, and wherein the angular range of motion can be changed by adjusting the first adjustable coupling mechanism, by adjusting the second adjustable coupling mechanism, or by adjusting both the first adjustable coupling mechanism and the second adjustable coupling mechanism.

14. A method of constructing a manual fork lift system, the method comprising:

providing a frame comprising a base, a mast coupled with the base, an extendable boom pivotally coupled with the mast, and an engagement mechanism pivotally coupled with the extendable boom, wherein the extendable boom includes a proximal support element and a distal support element that is slidably engaged with the proximal support element;

providing a first single-action hydraulic jack comprising a base and a ram, wherein the base of the first single-action hydraulic jack is pivotally coupled with the base of the frame, and the ram of the first single-action hydraulic jack is pivotally coupled with the extendable boom of the frame; and providing a second single-action hydraulic jack comprising a base and a ram, wherein the base of the second single-action hydraulic jack is pivotally coupled with a lower portion of the engagement mechanism of the frame via a first adjustable coupling mechanism, and the ram of the second single-action hydraulic jack is pivotally coupled with the extendable boom of the frame via a second adjustable coupling mechanism, constructing the manual fork lift system such that the first adjustable coupling mechanism allows the base of the second single-action hydraulic jack to be translationally adjusted along a length of the engagement mechanism, and such that the second adjustable coupling mechanism allows the ram of the second single-action hydraulic jack to be adjustably positioned along a length of the extendable boom.

15. The method according to claim 14, wherein the first adjustable coupling mechanism comprises a jack support having a first aperture, an engagement mechanism bracket having a second aperture, and a pin that can be received through the first aperture and the second aperture, wherein the jack support is coupled with the base of the second single-action hydraulic jack.

16. The method according to claim 14, wherein the base of the second single-action hydraulic jack comprises a first aperture, and wherein the first adjustable coupling mechanism comprises an engagement mechanism bracket having a second aperture, and a pin that can be received through the first aperture and the second aperture.

17. The method according to claim 14, wherein the boom comprises an aperture, wherein the second adjustable coupling mechanism comprises a boom bracket having an aperture, and a pin that can be received through the boom bracket aperture and the boom aperture, and wherein the ram of the second single-action hydraulic jack is coupled with the boom bracket.

18. The method according to claim 14, wherein the boom comprises a plurality of apertures, wherein the second adjustable coupling mechanism comprises a boom bracket having a plurality of apertures, and a pin, and wherein the ram of the second single-action hydraulic jack is coupled with the boom bracket.

19. The method according to claim 14, wherein the boom proximal support element comprise an aperture, wherein the boom distal support element comprises an aperture, wherein the second adjustable coupling mechanism comprises a boom bracket having an aperture, and a pin that can be received through the boom proximal support element aperture, the boom distal support element aperture, and the bracket aperture, and wherein the ram of the second single-action hydraulic jack is coupled with the boom bracket.

20. The method according to claim 14, wherein the boom proximal support element comprises a plurality of apertures, wherein the boom distal support element comprises a plurality of apertures, wherein the second adjustable coupling mechanism comprises a boom bracket having a plurality of apertures, and a pin, and wherein the ram of the second single-action hydraulic jack is coupled with the boom bracket.

* * * * *

UNITED STATES PATENT AND TRADEMARK OFFICE

CERTIFICATE OF CORRECTION

PATENT NO. : 8,047,759 B2
APPLICATION NO. : 12/399731
DATED : November 1, 2011
INVENTOR(S) : Ladd It is certified that error appears in the above-identified patent and that said Letters Patent is hereby corrected as shown below:

Column 11, line 3, please delete “alone” and insert --along--.

Signed and Sealed this
Third Day of January, 2012

David J. Kappos

David J. Kappos
*Director of the United States Patent and Trademark Office*